US009164523B2

(12) United States Patent
Chen

(10) Patent No.: US 9,164,523 B2
(45) Date of Patent: Oct. 20, 2015

(54) VOLTAGE REGULATOR HAVING A PLURALITY OF CAPACITORS CONFIGURED TO OBTAIN A FEEDBACK VOLTAGE FROM A DIVISION VOLTAGE

(75) Inventor: Hung-I Chen, Kaohsiung (TW)

(73) Assignee: MEDIATEK INC., Hsin-Chu (TW)

( * ) Notice: Subject to any disclaimer, the term of this patent is extended or adjusted under 35 U.S.C. 154(b) by 918 days.

(21) Appl. No.: 12/354,968

(22) Filed: Jan. 16, 2009

(65) Prior Publication Data

US 2010/0181974 A1 Jul. 22, 2010

(51) Int. Cl.
*G05F 1/575* (2006.01)

(52) U.S. Cl.
CPC ..... *G05F 1/575* (2013.01)

(58) Field of Classification Search
CPC ..... G05F 1/575; G05F 1/10; G05F 1/56; G05F 1/59; H02M 3/18
USPC ..... 363/62; 323/273, 274, 280, 281; 307/109
See application file for complete search history.

(56) References Cited

U.S. PATENT DOCUMENTS

| | | | | |
|---|---|---|---|---|
| 5,680,300 | A * | 10/1997 | Szepesi et al. | 363/59 |
| 7,068,019 | B1 | 6/2006 | Chiu | |
| 7,099,167 | B2 | 8/2006 | Fujise | |
| 7,414,371 | B1 * | 8/2008 | Choi et al. | 315/291 |
| 2002/0145413 | A1 * | 10/2002 | Oshio | 323/371 |
| 2003/0040294 | A1 * | 2/2003 | Staszewski et al. | 455/337 |
| 2004/0136213 | A1 * | 7/2004 | Fujise | 363/62 |
| 2005/0122751 | A1 * | 6/2005 | Zeng et al. | 363/50 |
| 2008/0129225 | A1 * | 6/2008 | Yamamoto et al. | 315/307 |
| 2009/0237046 | A1 * | 9/2009 | Hsieh et al. | 323/273 |

FOREIGN PATENT DOCUMENTS

| | | |
|---|---|---|
| CN | 101069339 | 11/2007 |
| EP | 0 981 077 | 2/2000 |

OTHER PUBLICATIONS

English language translation of abstract of CN 101069339 (published Nov. 7, 2007).

* cited by examiner

*Primary Examiner* — Fred E Finch, III
*Assistant Examiner* — Gustavo Rosario Benitez
(74) *Attorney, Agent, or Firm* — McClure, Qualey & Rodack, LLP

(57) ABSTRACT

An electronic circuit is provided. An error amplifier comprises a first input terminal coupled to a reference voltage, a second input terminal coupled to a feedback voltage, and a transistor comprises a first terminal coupled to an input voltage, a control terminal coupled to an output terminal of the error amplifier and a second terminal outputting an output voltage. A switching-capacitor circuit is coupled between the output voltage and the error amplifier and comprises a plurality of switching elements and at least first and second capacitors. The switching elements are switched by non-overlapping clocks such that the second capacitor is discharged to a bias voltage during a first period, and the first and second capacitors are connected together during a second period thereby extracting a division voltage from the output voltage to serve as the feedback voltage.

6 Claims, 8 Drawing Sheets

VOLTAGE REGULATOR HAVING A PLURALITY OF CAPACITORS CONFIGURED TO OBTAIN A FEEDBACK VOLTAGE FROM A DIVISION VOLTAGE

BACKGROUND OF THE INVENTION

1. Field of the Invention

The invention relates to voltage regulators, and in particular to voltage regulators using switching elements and capacitors to serve as a feedback resistor.

2. Description of the Related Art

Power management control systems including voltage regulators are incorporated within portable electronic devices, such as laptop computers, hand-held electronic devices, and cellular phones, to generate a stable output voltage from a varying input voltage supply. The purpose of the voltage regulator is to regulate the external power supplied to the internal circuitry for efficient current usage or quiescent power. The useable operating voltage is called the "drop-out" voltage, which is the difference between the input and output voltages of regulator regulation. The smaller the difference, the more efficient the system. Additionally, batteries can supply only a finite amount of charge, so, the more quiescent current the regulator uses, the less operating lifespan the battery will have and therefore the system will be less efficient.

BRIEF SUMMARY OF THE INVENTION

Embodiments of an electronic circuit are provided, in which a voltage regulation unit converts an input voltage to an output voltage by comparing a reference voltage and a feedback voltage. Additionally, a switching-capacitor circuit is coupled between the output voltage and the voltage regulation unit and comprises a plurality of switching elements and at least first and second capacitors. The first and second capacitor extracts a division voltage from the output voltage by charge sharing between the first and second capacitors to obtain the feedback voltage.

The invention provides an embodiment of an electronic circuit, in which a voltage regulation unit converts an input voltage to an output voltage by comparing a reference voltage and a feedback voltage, a first capacitor comprises a first terminal coupled to the output voltage, a first switching element comprises a first terminal coupled to the first terminal of the first capacitor and a second terminal coupled to a second terminal of the first capacitor, and a second switching element comprises a first terminal coupled to the second terminal of the first capacitor and the second terminal of the first switching element, and a second terminal coupled to the voltage regulation unit. A third switching element comprises a first terminal coupled to the second terminal of the second switching element, a second capacitor comprises a first terminal coupled to a second terminal of the third switching element, and a second terminal coupled to a ground voltage, and a fourth switching element comprises a first terminal coupled to a first terminal of the second capacitor and the second terminal of the third switching element and a second terminal coupled to the ground voltage.

The invention provides an embodiment of an electronic circuit, in which a voltage regulation unit converts an input voltage to an output voltage by comparing a reference voltage and a feedback voltage, a first switching element comprises a first terminal coupled to the output voltage, a first capacitor comprising a first terminal coupled to a second terminal of the first switching element and a second terminal coupled to a ground voltage, and a second switching element comprises a first terminal coupled to the first terminal of the first capacitor and the second terminal of the first switching element. A second capacitor comprises a first terminal coupled to a second terminal of the second switching element and a second terminal coupled to the ground voltage, a third switching element comprises a first terminal coupled to the second terminal of the second switching element and the first terminal of the second capacitor and a second terminal coupled to the ground voltage, and a fourth switching element comprises a first terminal coupled to the first terminal of the first capacitor and the second terminal of the first switching element and a second terminal coupled to the voltage regulation unit.

The invention provides an embodiment of a voltage regulator, in which an error amplifier comprises a first input terminal coupled to a reference voltage, a second input terminal coupled to a feedback voltage, and a transistor comprises a first terminal coupled to an input voltage, a control terminal coupled to an output terminal of the error amplifier and a second terminal outputting an output voltage. A switching-capacitor circuit is coupled between the output voltage and the error amplifier and comprises a plurality of switching elements and at least first and second capacitors. The switching elements are switched by non-overlapping clocks such that the second capacitor is discharged to a ground voltage during a first period, and the first and second capacitors are connected together during a second period thereby extracting a division voltage of the output voltage to serve as the feedback voltage.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
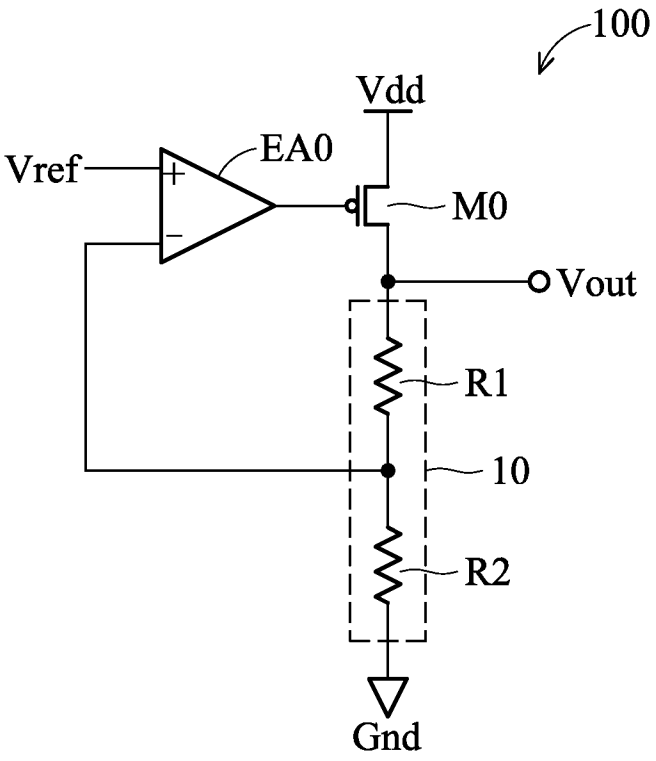
FIG. 1 shows an embodiment of a voltage regulator.

FIG. 1 shows an embodiment of a voltage regulator. As shown, the voltage regulator 100 can be a low drop-out (LDO) voltage regulator or a low quiescent current regulator and comprises an error amplifier EA0, a PMOS pass transistor M0 and a feedback resistor series 10 having a resistor series (i.e., resistors R1 and R2). When the output voltage Vout is designed to be larger than a predetermined voltage level and the current through the resistors R1 and R2 are limited, resistances of the resistor series (R1 and R2) are required to be very large such that the layout area thereof is accordingly increased. For example, when the output voltage Vout is designed to be 2.8V and the current through the resistors R1 and R2 are limited at 0.5 μA, the total resistance of the resistors R1 and R2 is required to be 5.6MΩ. Generally, a power management IC comprises more than 10 LDO voltage regulators, and thus, the feedback resistor series in all LDO voltage regulators would occupy an overwhelming majority of layout area when considering required low current.

In order to reduce layout are of such LDO voltage regulators in the power management IC, embodiments of the invention utilize a switching-capacitor (SC) circuit to be implemented as the feedback resistor.

Figure 2:
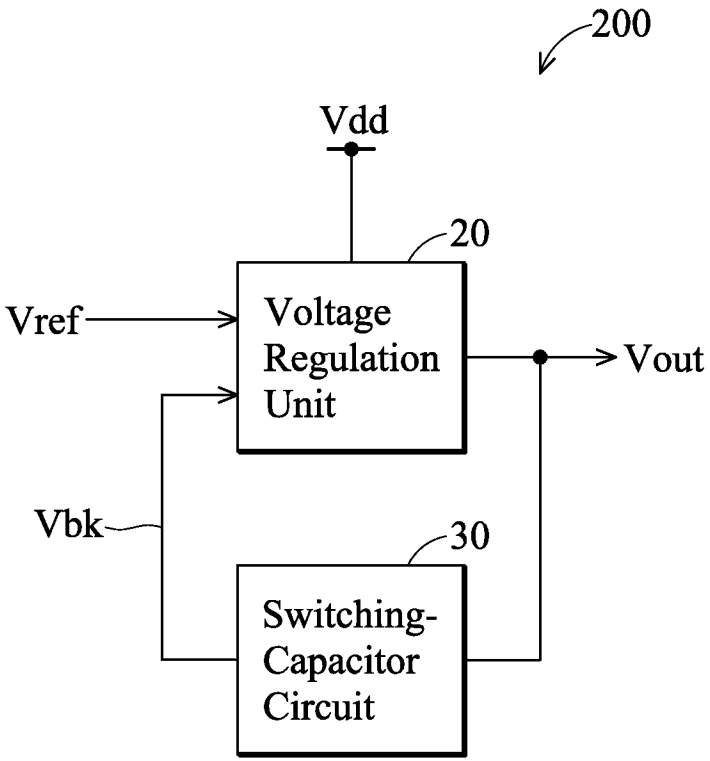
FIG. 2 shows a diagram of a voltage regulator.

FIG. 2 shows a diagram of a voltage regulator. As shown, voltage regulator 200 comprises a voltage regulator unit 20 and a switching-capacitor (SC) circuit 30. For example, the voltage regulator 20 can be a low quiescent current regulator, a charge-pump circuit, a switching-mode power supply or a low drop-out (LDO) voltage regulator, but is not limited thereto. The voltage regulator unit 20 converts an input voltage Vdd to an output voltage Vout by comparing a reference voltage Vref and a feedback voltage Vbk. The switching-capacitor circuit 30 is coupled between the output voltage Vout and the voltage regulation unit 20 and comprises a plurality of switching elements and at least two capacitors (shown in following figures). The switching elements in the switching-capacitor circuit 30 are switched by non-overlapping clocks such that one capacitor is discharged to a bias voltage during a first period, and the two capacitors are connected together during a second period thereby obtaining a division voltage of the output voltage Vout and serving as the feedback voltage Vbk. Namely, the switching-capacitor circuit 30 performs a voltage-division to the output voltage Vout by charge sharing between the two capacitors to obtain the feedback voltage Vbk.

For example, the switching elements in the switching-capacitor circuit 30 are switched such that two terminals of one of the two capacitors are coupled to the output voltage Vout during a first period and the two capacitors are connected in series during a second period to obtain the division voltage of the output voltage Vout and serve as the feedback voltage Vbk. Alternatively, the switching elements in the switching-capacitor circuit are switched such that one of the two capacitors is charged by the output voltage Vout during a first period, and the two capacitors are connected in parallel to obtain the division voltage of the output voltage Vout and serve as the feedback voltage Vbk during the second period.

Figure 3:
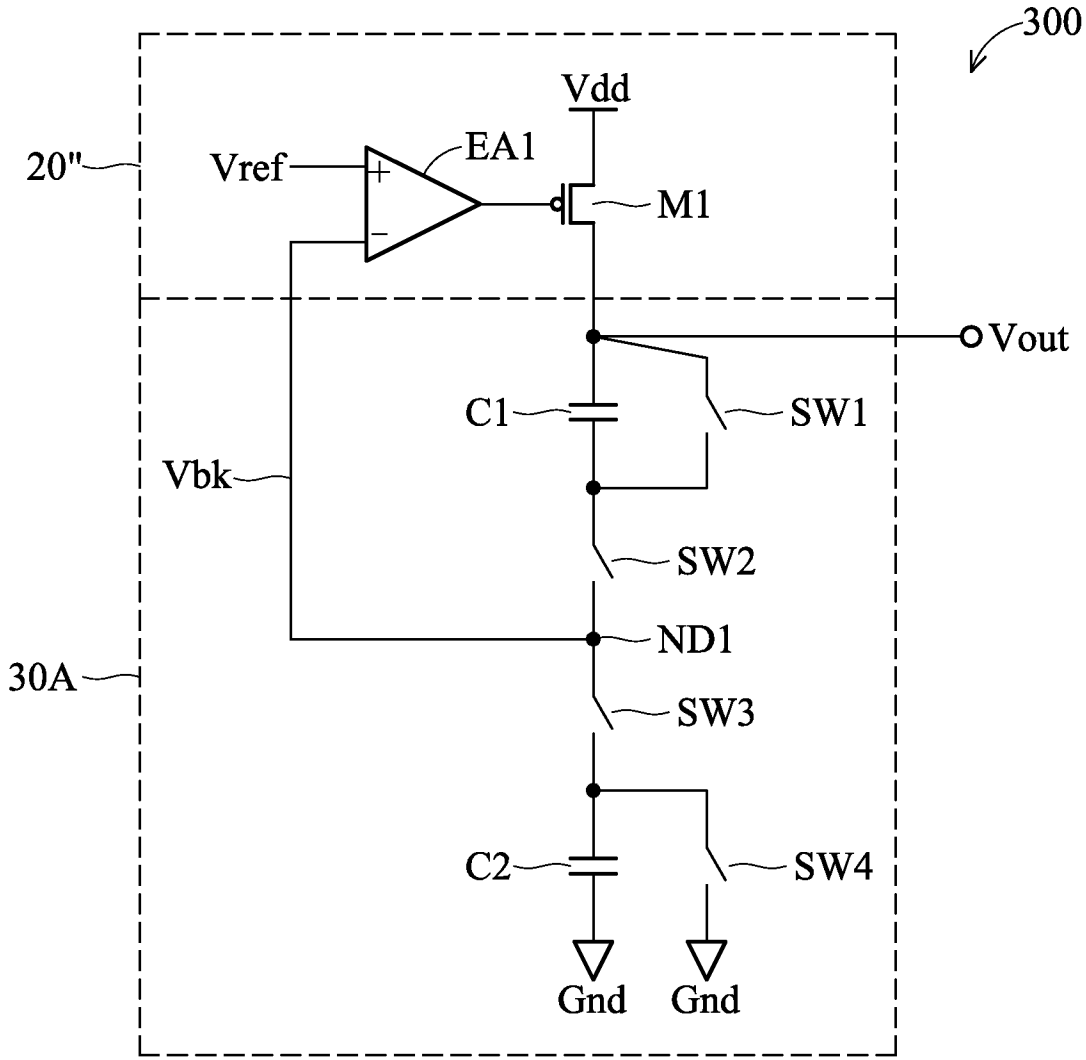
FIG. 3 shows another embodiment of a voltage regulator.

FIG. 3 shows another embodiment of a voltage regulator. As shown, a voltage regulator 300 comprises a voltage regulation unit 20" converting the input voltage Vdd to the output voltage Vout and a switching-capacitor circuit 30A providing the feedback voltage Vbk to the voltage regulation unit 20" according to the output voltage Vout. The voltage regulation unit 20" comprises an error amplifier EA1 and a PMOS pass transistor M1. The error amplifier EA1 comprises a first input terminal coupled to the reference voltage Vref, a second input terminal coupled to the feedback voltage Vbk, and an output terminal coupled to the transistor M1. The transistor M1 comprises a first terminal coupled to the input voltage Vdd, a control terminal coupled to the output terminal of the error amplifier EA1 and a second terminal outputting the output voltage Vout.

The voltage regulator unit 20" converts the input voltage Vdd to the output voltage Vout by comparing the reference voltage Vref and the feedback voltage Vbk from the switching-capacitor circuit 30A. For example, when the feedback voltage Vbk is higher than the reference voltage Vref, the error amplifier EA1 lowers the voltage on the control terminal of the transistor M1 such that the output voltage Vout is increased. On the contrary, when the feedback voltage Vbk is lower than the reference voltage Vref, the error amplifier EA1 increases the voltage on the control terminal of the transistor M1 such that the output voltage Vout is lowered. Thus, the voltage regulator unit 20" can maintain the output voltage Vout at a desired voltage level according to the reference voltage Vref and the feedback voltage Vbk.

The switching-capacitor circuit 30A comprises capacitors C1 and C2 and switching elements SW1~SW4. The capacitor C1 has a first terminal coupled to the output voltage Vout and a second terminal coupled to the switching element SW2. The switching element SW1 has a first terminal coupled to the first terminal of the capacitor C1, and a second terminal coupled to the second terminal of the capacitor C1. The switching element SW2 has a first terminal coupled to the second terminal of the capacitor C1 and a second terminal coupled a node ND1, in which the voltage at the node ND1 serves as the feedback voltage Vbk. The switching element SW3 has a first terminal coupled to the node ND1 and a second terminal coupled to the capacitor C2 and the switching element SW4. The capacitor C2 has a first terminal coupled to the second terminal of the switching element SW3 and a second terminal coupled to a bias voltage (here a ground voltage Gnd is served as the bias voltage). The switching element SW4 has a first terminal coupled to the first terminal of the capacitor C2 and a second terminal coupled to the ground voltage Gnd.

Figure 4:
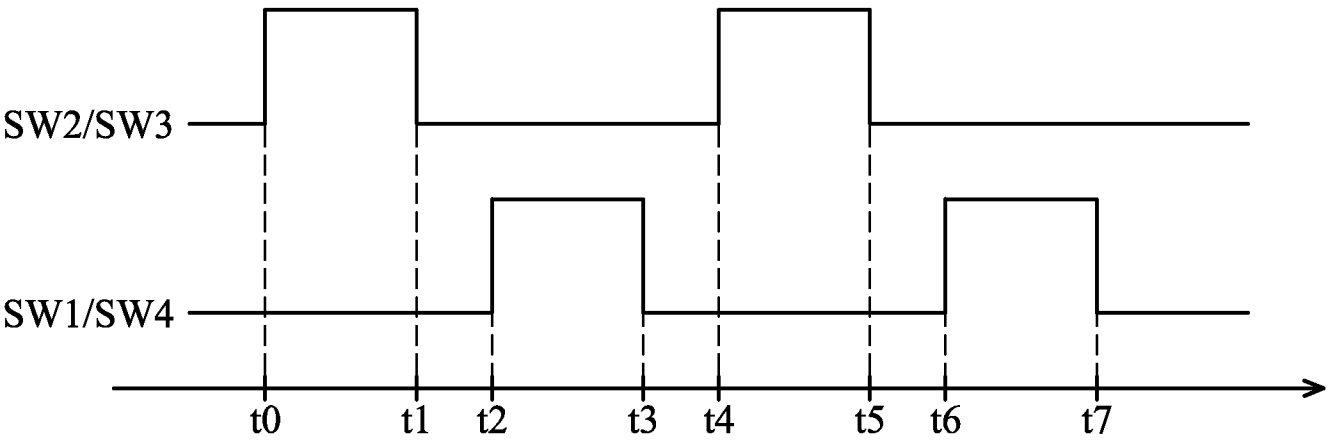
FIG. 4 shows a control timing chart of the switching elements in the switching-capacitor circuit shown in FIG. 3.

FIG. 4 shows a control timing chart of the switching elements in the switching-capacitor circuit shown in FIG. 3. Operations of the switching-capacitor circuit 30A are described with reference to FIGS. 3 and 4. As shown, during a time period t0~t1, the switching elements SW1 and SW4 are tuned off and the switching elements SW2 and SW3 are turned on, the capacitors C1 and C2 extracts a division voltage from the output voltage Vout to serve as the feedback voltage Vbk (i.e., the voltage on the node ND1). For example, the capacitors C1 and C2 extract the division voltage from the output voltage Vout by charge sharing therebetween to serve as the feedback voltage Vbk. During a time period t1~t2, all switching elements SW1~SW4 are turned off. Because the switching elements SW2 and SW3 are turned off, the voltage at the node ND1 (i.e., the feedback voltage Vbk) is maintained (i.e., the same as the last time period t0~t1). Then, during a time period t2~t3, the switching elements SW1 and SW4 are turned on and the switching elements SW2 and SW3 are turned off, such that two terminals of the capacitor C1 are both coupled to the output voltage Vout, and two terminals of the capacitor C2 are both coupled to the ground voltage Gnd.

Next, during a time period t3~t4, all switching elements SW1~SW4 are turned off again. During a time period t4~t5, the switching elements SW1 and SW4 are tuned off and the switching elements SW2 and SW3 are turned on, the capacitors C1 and C2 extracts a division voltage from the output voltage Vout again. Then, during a time period t5~t6, the switching elements SW1~SW4 are turned off. Because the switching elements SW2 and SW3 are turned off, the voltage at the node ND1 (i.e., the feedback voltage Vbk) is maintained (i.e., the same as the last time period t4~t5).

During a time period t6~t7, the switching elements SW1 and SW4 are turned on and the switching elements SW2 and SW3 are turned off, such that two terminals of the capacitor C1 are both coupled to the output voltage Vout, and two terminals of the capacitor C2 are both coupled to the ground voltage Gnd both, and so on.

In this embodiment, the capacitor C1 and the switching elements SW1 and SW2 can be regarded as a first resistor and the capacitor C2 and the switching elements SW3 and SW4 can be regarded as a second resistor. Equivalent resistance of the first and second resistors can be considered as T1/C11 and T2/C22 respectively, in which C11 represents the capacitance of the capacitor C1, C22 represents the capacitance of the capacitor C2, T1 represents the duty period of the switching element SW1 and T2 represents the duty period of the switching element SW4. For example, the resistance of 1MΩ can be obtained when the capacitor C1 is 1 pF and the switching element SW1 is operated at 1 MHz (i.e., duty period is $10^{-6}$ sec). Namely, the resistance of the first and second resistors can be modified by different capacitances and different duty period of switching elements SW1~SW4.

Figure 5:
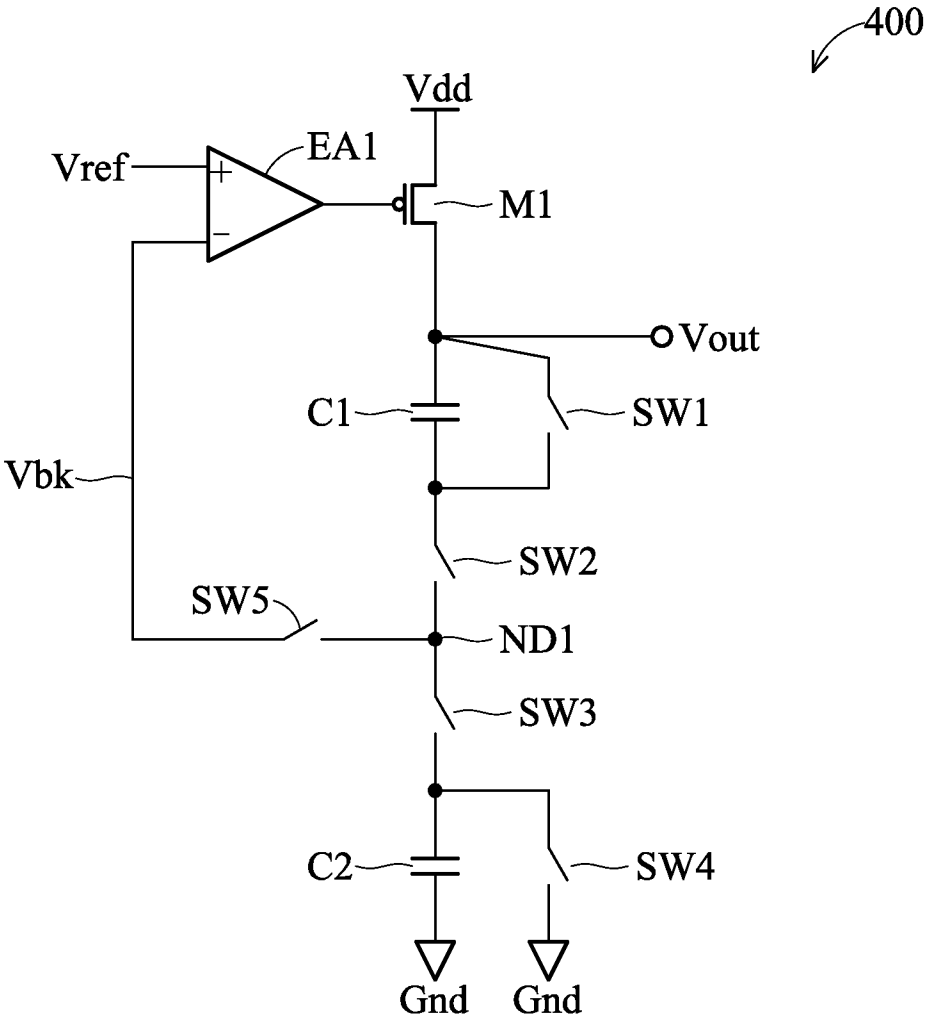
FIG. 5 shows another embodiment of the voltage regulator.
Figure 6:
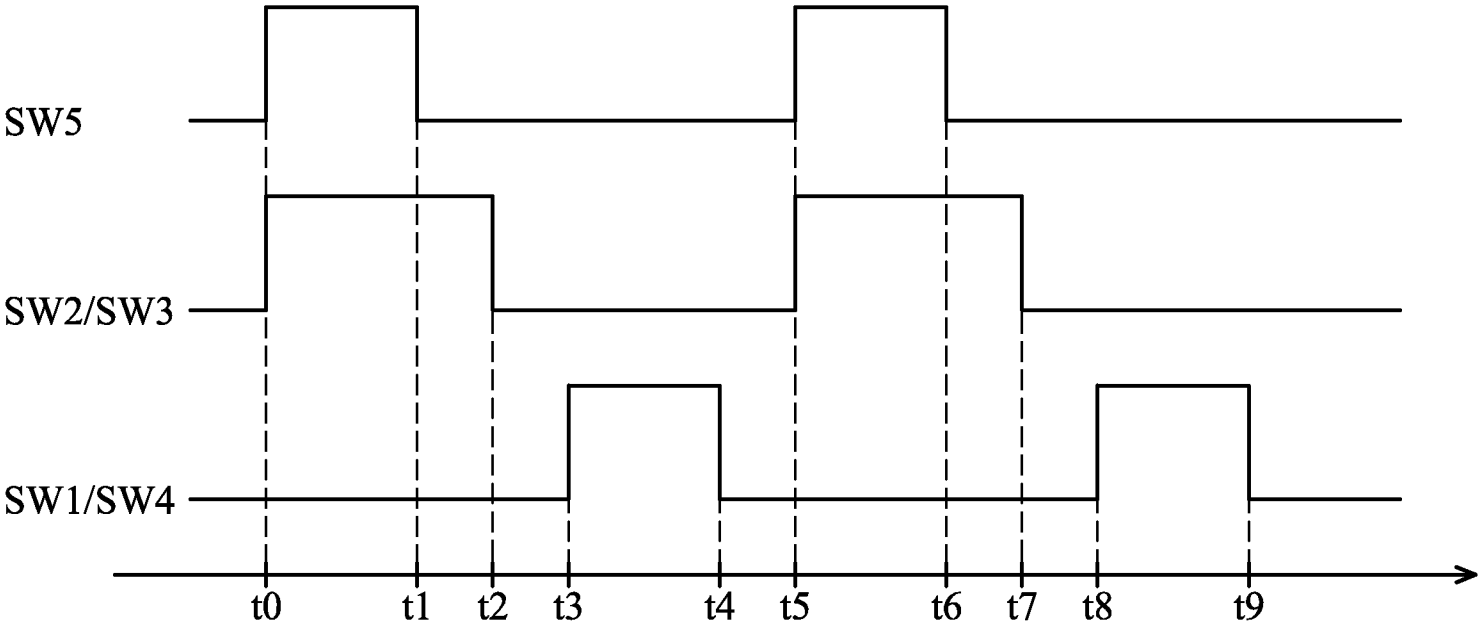
FIG. 6 shows a control timing chart of the switching elements in the switching-capacitor circuit shown in FIG. 5.

FIG. 5 shows another embodiment of the voltage regulator. As shown, the voltage regulator 400 is similar to the voltage regulator 300 shown in FIG. 3, except that a switching element SW5 is coupled between the node ND1 and the second input terminal of the error amplifier EA1. FIG. 6 shows a control timing chart of the switching elements in the switching-capacitor circuit shown in FIG. 5. Operations of the switching-capacitor circuit in the voltage regulator 400 are described with reference to FIGS. 5 and 6.

As shown, during a time period t0~t1, the switching elements SW1 and SW4 are tuned off and the switching elements SW2, SW3 and SW5 are turned on, the capacitors C1 and C2 extracts a division voltage from the output voltage Vout to serve the feedback voltage Vbk (i.e., the voltage on the node ND1). At time t1, the switching elements SW1 and SW4 remain off and the switching elements SW2 and SW3 remain on, and the switching element SW5 is turned off. Hence, the voltage at the second input terminal of the error amplifier EA1 (i.e., the feedback voltage Vbk) is maintained (i.e., the same as the last time period t0~t1).

At time period t2, the switching elements SW1, SW4 and SW5 remain off and the switching elements SW2 and SW3 are turned off. During a time period t2~t3, all switching elements SW1~SW5 remain off. Then, during a time period t3~t4, the switching elements SW2, SW3 and SW5 remain off and the switching elements SW1 and SW4 are turned on such that two terminals of the capacitor C1 are both coupled to the output voltage Vout, and two terminals of the capacitor C2 are both coupled to the ground voltage Gnd both. Next, at time t4, the SW2, SW3 and SW5 remain off and the switching elements SW1 and SW4 are turned off. Then, during a time period t4~t5, all switching elements SW1~SW5 remain off. The operations during time period t5~t9 is similar to that during the time period t0~t5, and so on.

Figure 7:
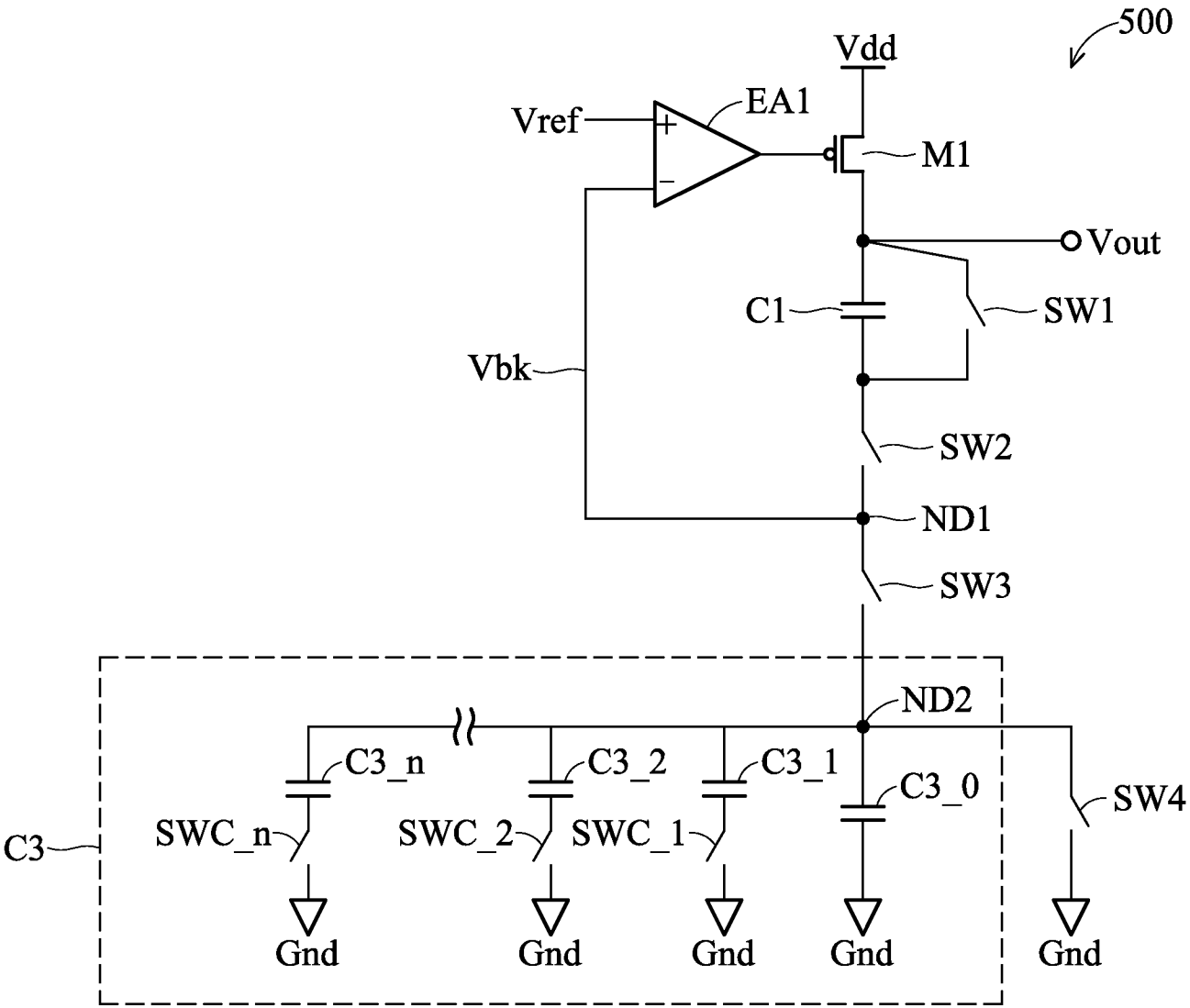
FIG. 7 shows another embodiment of a voltage regulator.

FIG. 7 shows another embodiment of a voltage regulator. As shown, a voltage regulator 500 is similar to the voltage regulator 300 shown in FIG. 3, except that the capacitor C2 is replaced by a variable capacitor C3. The variable capacitor C3 comprises capacitors C3_0~C3_*n* and switching elements SWC_1~SWC_n. The capacitor C3_0 is coupled between a node ND2 and the ground voltage Gnd, the capacitor C3_1 and the switching element SWC_1 are connected in series between the node ND2 and the ground voltage Gnd, the capacitor C3_2 and the switching element SWC_2 are connected in series between the node ND2 and the ground voltage Gnd, and so on. When the switching element SWC_1 is turned on, the capacitors C3_0 and C3_1 are connected in parallel and the capacitance of the variable capacitor C3 is increased. When the switching elements SWC_1~SWC_2 are both turned on, the capacitors C3_0~C3_2 are connected in parallel and the capacitance of the variable capacitor C3 is further increased, and so on. Namely, the more of the switching elements SWC_1~SWC_n are turned on, the larger the capacitance of the variable capacitor C3. Operations of the voltage regulator 500 are similar to that of the voltage regulator 300 shown in FIG. 3 and thus, are omitted for brevity. The voltage regulator 500 can adjust voltage level of the output voltage Vout by tuning the capacitance of the variable capacitor C3.

Figure 8:
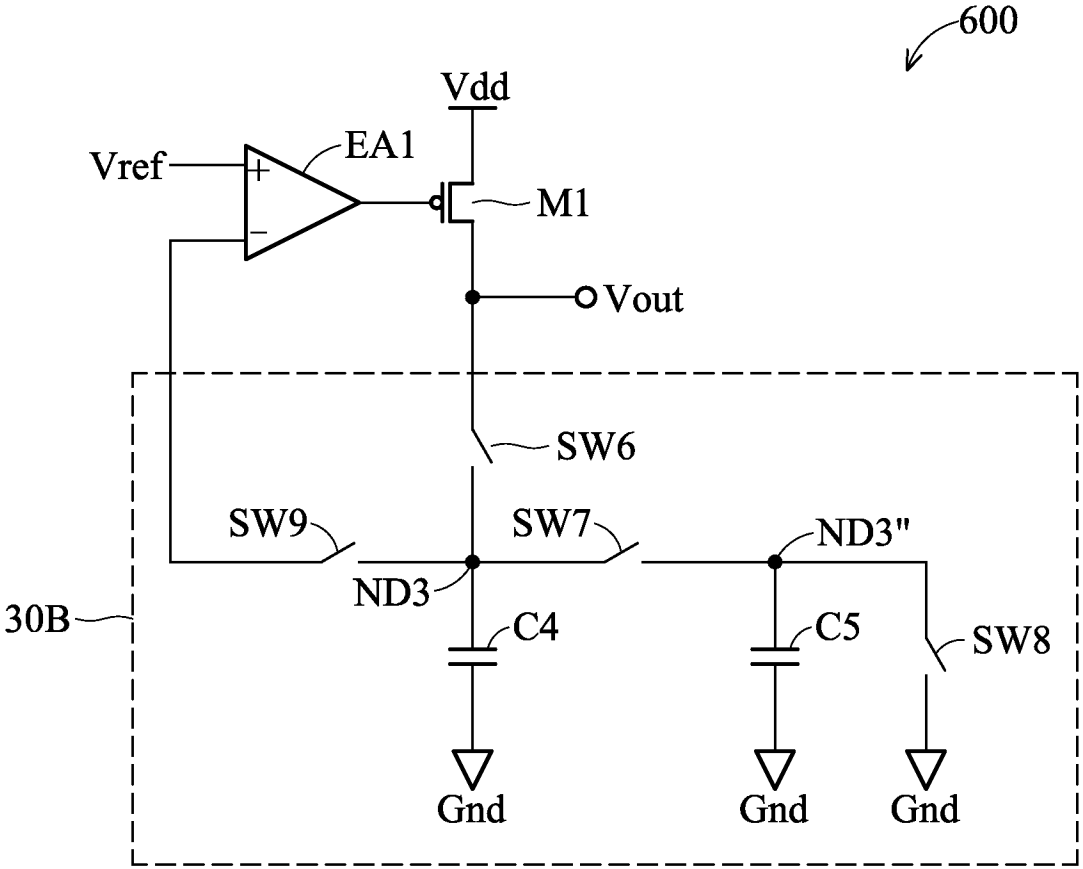
FIG. 8 shows another embodiment of a voltage regulator.

FIG. 8 shows another embodiment of a voltage regulator. As shown, a voltage regulator 600 is similar to the voltage regulator 300 shown in FIG. 3, except that the switching-capacitor circuit 30A is replaced with a switching-capacitor circuit 30B. The switching-capacitor circuit 30B comprises switching elements SW6~SW9 and capacitors C4~C5. The switching element SW6 has a first terminal coupled to the output voltage Vout and a second terminal coupled to a node ND3. The capacitor C4 has a first terminal coupled to the node ND3 and a second terminal coupled to the ground voltage Gnd. The switching element SW7 has a first terminal coupled to the node ND3 and a second terminal coupled to a node ND3". The capacitor C5 has a first terminal coupled to the node ND3" and a second terminal coupled to the ground voltage Gnd. The switching element SW8 has a first terminal coupled to the node ND3" and a second terminal coupled to the ground voltage Gnd. The switching element SW9 has a first terminal coupled to the node ND3 and a second terminal coupled to the second terminal input terminal of the error amplifier EA1.

Figure 9:
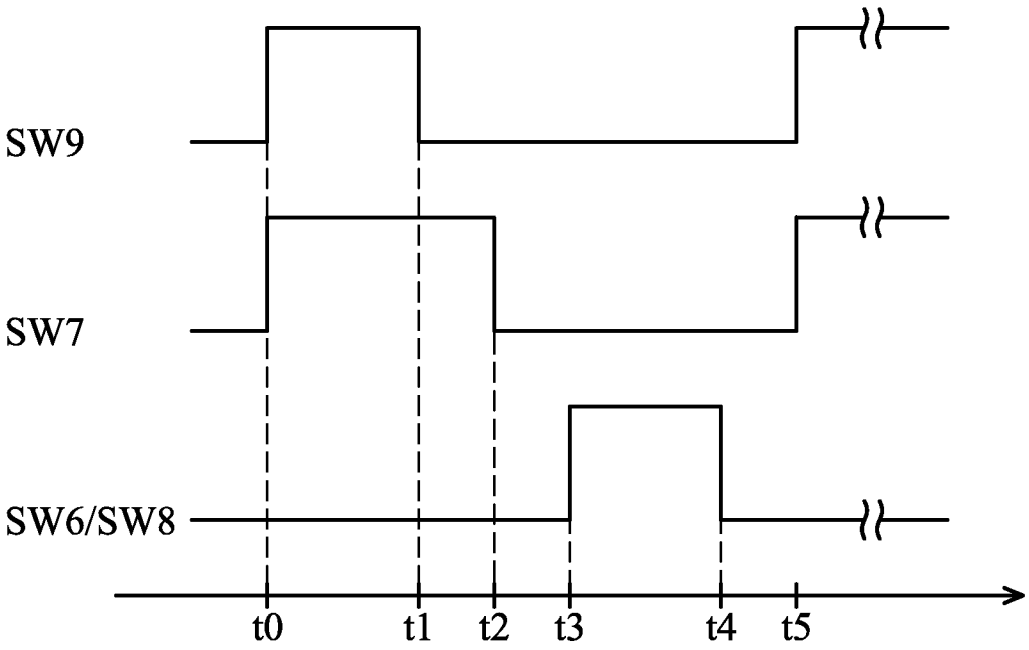
FIG. 9 shows a control timing chart of the switching elements in the switching-capacitor circuit shown in FIG. 8.

FIG. 9 shows a control timing chart of the switching elements in the switching-capacitor circuit shown in FIG. 8. Operations of the switching-capacitor circuit 30B are described with reference to FIGS. 8 and 9.

As shown, during a time period t0~t1, the switching elements SW6 and SW8 are tuned off and the switching elements SW7 and SW9 are turned on, the capacitors C1 and C2 perform a voltage-division to the output voltage Vout to serve the feedback voltage Vbk. For example, the output voltage Vout stored in the capacitor C4 charges the capacitor C5, i.e., charge sharing between capacitors C4 and C5 are executed, to extracts the division voltage of the output voltage Vout to serve as the feedback voltage Vbk.

At time t1, the switching elements SW6 and SW8 remain off and the switching elements SW7 remains on, and the switching element SW9 is turned off. Hence, the voltage at the second input terminal of the error amplifier EA1 (i.e., the feedback voltage Vbk) is maintained (i.e., the same as the last time period t0~t1). At time period t2, the switching elements SW6, SW8 and SW9 remain off and the switching element SW7 is turned off. During a time period t2~t3, all switching elements SW1~SW5 remain off.

Then, during a time period t3~t4, the switching elements SW7 and SW9 remain off and the switching elements SW6 and SW8 are turned on such that the capacitor C4 is charged by the output voltage Vout and two terminals of the capacitor C5 are both coupled to the ground voltage Gnd. Next, at time t4, the SW7 and SW9 remain off and the switching elements SW6 and SW8 are turned off. Then, during a time period t4~t5, all switching elements SW6~SW9 remain off. The operations during time period t5~t9 are repeated.

In some embodiments, the capacitor C4 or the capacitor C5 can be replaced with the variable capacitor C3 shown in FIG. 7 for adjusting the output voltage Vout to a wanted voltage level. Because capacitance per unit is increased more and more in advanced semiconductor processes, it is more efficient to replace the feedback resistor with capacitors and switching elements and thus the layout area of the voltage regulator can be reduced. In some embodiment, the capacitors C1~C5 or C3_0~C3_*n* can also be implemented on the active devices during forming of metal-insulator-metal devices or metal-on-metal devices, and thus, the capacitors C1~C5 or C3_0~C3_*n* do not increase a chip's layout area.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic circuit, comprising:

a voltage regulation unit converting an input voltage to an output voltage by comparing a reference voltage and a feedback voltage;

a first capacitor comprising a first terminal coupled to the output voltage, and a second terminal;

a first switching element comprising a first terminal coupled to the first terminal of the first capacitor, and a second terminal coupled to the second terminal of the first capacitor;

a second switching element comprising a first terminal coupled to the second terminal of the first capacitor and the second terminal of the first switching element, and a second terminal coupled to the voltage regulation unit;

a third switching element comprising a first terminal coupled to the second terminal of the second switching element, and a second terminal;

a second capacitor comprising a first terminal coupled to the second terminal of the third switching element, and a second terminal coupled to a bias voltage, wherein the first and second capacitors extract a division voltage from the output voltage by charge sharing between the first and second capacitors to obtain the feedback voltage; and a fourth switching element comprising a first terminal coupled to a first terminal of the second capacitor and the second terminal of the third switching element, and a second terminal coupled to the bias voltage, wherein the charge sharing is accomplished through switching operations of the first, second, third and fourth switching elements;

wherein the division voltage is a voltage on a connection point of the first and second capacitors, and the switching elements are switched by non-overlapping clocks, such that the first and second capacitors are not connected at the connection point during a first period and the first and second capacitors are connected at the connection point to perform the charge sharing during a second period different from the first period;

wherein one or more of: first and second terminals of the first capacitor are directly connected together through a switch element during the first period; or first and second terminals of the second capacitor are directly connected together through a switch element during the first period.

2. The electronic circuit as claimed in claim 1, wherein the electronic circuit is a voltage regulator.

3. The electronic circuit as claimed in claim 1, wherein one of the first and second capacitors is a variable capacitor.

4. The electronic circuit as claimed in claim 1, wherein the voltage regulation unit is a switching-mode power supply, or a charge-pump circuit.

5. The electronic circuit as claimed in claim 2, further comprises a fifth switching element comprises a first terminal coupled to the voltage regulation unit, and a second terminal coupled to the second terminal of the second switching element and the first terminal of the third switching element.

6. An electronic circuit, comprising:

a voltage regulation unit converting an input voltage to an output voltage by comparing a reference voltage and a feedback voltage;

a first switching element comprising a first terminal coupled to the output voltage, and a second terminal;

a first capacitor comprising a first terminal coupled to the second terminal of the first switching element, and a second terminal coupled to a bias voltage;

a second switching element comprising a first terminal coupled to the first terminal of the first capacitor and the second terminal of the first switching element, and a second terminal;

a second capacitor comprising a first terminal coupled to the second terminal of the second switching element, and a second terminal coupled to the bias voltage, wherein the first and second capacitors extract a division voltage from the output voltage by charge sharing between the first and second capacitors to obtain the feedback voltage, and the charge sharing is through switching operations of the switching elements;

a third switching element comprising a first terminal coupled to the second terminal of the second switching element and the first terminal of the second capacitor, and a second terminal coupled to the bias voltage; and a fourth switching element comprising a first terminal coupled to the first terminal of the first capacitor and the second terminal of the first switching element, and a second terminal coupled to the voltage regulation unit, wherein the charge sharing is accomplished through switching operations of the first, second, third and fourth switching elements;

wherein the division voltage is a voltage on a connection point of the first and second capacitors, and the switching elements are switched by non-overlapping clocks, such that the first and second capacitors are not connected at the connection point during a first period and the first and second capacitors are connected at the connection point to perform the charge sharing during a second period different from the first period;

wherein one or more of: first and second terminals of the first capacitor are directly connected together through a switch element during the first period; or first and second terminals of the second capacitor are directly connected together through a switch element during the first period.

* * * * *